US006416366B2

(12) United States Patent
Endo et al.

(10) Patent No.: US 6,416,366 B2
(45) Date of Patent: Jul. 9, 2002

(54) TERMINAL METAL FITTING

(75) Inventors: Takayoshi Endo; Naotoshi Sato, both of Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 09/766,640

(22) Filed: Jan. 23, 2001

(30) Foreign Application Priority Data

Jan. 24, 2000 (JP) ..... 2000-014422

(51) Int. Cl.[7] ..... H01R 11/22
(52) U.S. Cl. ..... 439/851; 439/858
(58) Field of Search ..... 439/851, 852, 439/854, 856, 855, 857, 858, 862

(56) References Cited

U.S. PATENT DOCUMENTS

| | | | | | |
|---|---|---|---|---|---|
| 5,281,175 | A | * | 1/1994 | Chupak et al. | 439/839 |
| 5,624,289 | A | * | 4/1997 | Kourimsky et al. | 439/852 |
| 5,791,945 | A | * | 8/1998 | Myer et al. | 439/852 |
| 6,042,433 | A | * | 3/2000 | Chen | 439/852 |
| 6,095,873 | A | * | 8/2000 | Muramatsu et al. | 439/852 |
| 6,174,208 | B1 | * | 1/2001 | Chen | 439/852 |

FOREIGN PATENT DOCUMENTS

| | | |
|---|---|---|
| EP | 0 687 033 A2 | 12/1995 |
| JP | 5-62729 | 3/1993 |

* cited by examiner

*Primary Examiner*—Tulsidas Patel
(74) *Attorney, Agent, or Firm*—Armstrong, Westerman & Hattori, LLP

(57) ABSTRACT

A terminal metal fitting has a wire connecting portion to which an electric wire is connected and an electrically contacting portion to which a mating terminal metal fitting is connected. The electrically contacting portion is formed in a hollow quadrilateral cylinder. The mating terminal metal fitting has an insertion to be inserted into the electrically contacting portion. The electrically contacting portion has a flat bottom wall, a ceiling wall facing the bottom wall, and a pair of elastic pieces 15*a,* 15*b*. The elastic pieces 15*a,* 15*b* are arranged in an insertion direction of the insertion. One end portions 16*a,* 16*b* of the respective elastic pieces 15*a,* 15*b* integrally continue from the bottom wall. The elastic pieces 15*a,* 15*b* each are formed obliquely from the one end portions 16*a,* 16*b* toward the other end portions 17*a,* 17*b*, respectively, with respect to the bottom wall from the bottom wall toward the ceiling wall. End faces 18*a,* 18*b* of the other end portions 17*a,* 17*b* of the elastic pieces 15*a,* 15*b* face the insertion direction of the insertion into the electrically contacting portion.

4 Claims, 4 Drawing Sheets

TERMINAL METAL FITTING

BACKGROUND OF THE INVENTION

1. Field of the invention

The present invention relates to a terminal metal fitting for electrically connecting an electric wire to a connection terminal of electric parts such as busbar, electric relay or fuse.

2. Description of the Related Art

For example, a terminal metal fitting 101 shown in FIG.7 has been used for connection with a connection terminal of electric parts such as busbar, electric relay or fuse. The terminal metal fitting 101 is formed, for example, by bending a conductive metal plate and has a wire connecting portion 104 and an electrically contacting portion 105.

The metal plate to form the terminal metal fitting 101 is initially rectangular. The wire connecting portion 104 has a bottom wall 110*a* and cramping pieces 111 continuing from an edge of the bottom wall 110*a*. The wire connecting portion 104 is electrically connected to an electric wire 103 by inwardly bending the cramping pieces 111 after a wire-exposed end portion of the electric wire 103 has been put on the bottom wall 110*a*.

The electrically contacting portion 105 is cylindrical and has a bottom wall 110*b*, a ceiling wall 112 facing the bottom wall 110*b*, sidewalls 113 connecting the bottom wall 110*b* and the ceiling wall 112, and a pair of elastic pieces 115*a*,115*b*. The bottom wall 110*a* of the wire connecting portion 104 and the bottom wall 110*b* of the electrically contacting portion 105 are integrally formed in one plane.

The pair of elastic pieces 115*a*,115*b* each are formed in a belt-like shape and are integrally formed with the bottom wall 110*b*. The elastic pieces 115*a*,115*b* are arranged in a direction parallel with the electric wire 103 placed on the bottom wall 110*a*.

End portions 116*a*,116*b* (hereinafter, one end portions) of the respective elastic pieces 115*a*,115*b* integrally continue from the above bottom wall 110*b* and oppositely positioned apart from each other. End portions 117*a*,117*b* (hereinafter, other end portions) of the respective elastic pieces 115*a*, 115*b* are flatly arranged between the bottom wall 110*b* and the ceiling wall 112 parallel therewith and are positioned close to each other. In this way, the elastic pieces 115*a*,115*b* each are in a cantilevered state.

And, the elastic pieces 115*a*,115*b* have connecting portions 118*a*,118*b* connecting the one end portions 116*a*,116*b* and the other end portions 117*a*,117*b*, respectively. The connecting portions 118*a*,118*b* each are formed obliquely to the above bottom wall 110*b*, namely to the ceiling wall 112, from the bottom wall 110*b* toward the ceiling wall 112.

And, the other end portions 117*a*,117*b* of the pair of elastic pieces 115*a*,115*b* are in layers in a vertical direction and can be elastically-deformed contactably and discontactably with the above ceiling wall 112.

An insertion 102 of the above connection terminal (P in FIG.7) of electric parts is inserted among the bottom wall 110*b*, the ceiling wall 112, and the sidewalls 113 of the terminal metal fitting 101.

And, the insertion 102 having been inserted is put between the ceiling wall 112 and one, closer to the ceiling wall 112, of the elastic pieces 115*a*,115*b*, whereby the electric wire 103 connected to the wire connecting portion 104 is electrically connected with the insertion 102. In this state, the elastic pieces 115*a*,115*b* have an elastic restoring force to push the insertion 102 toward the ceiling wall 112.

With respect to the above prior art terminal metal fitting 101, however, since the other end portions 117*a*,117*b* of the pair of elastic pieces 115*a*,115*b* are in layers in vertical direction, a distance between the bottom wall 110*b* and the ceiling wall 112 is large.

And, in the prior art terminal metal fitting 101, the elastic pieces 115*a*,115*b* each are in a cantilevered state, wherein the one end portions 116*a*,116*b* each integrally continue from the bottom wall 110*b*. Therefore, since the elastic restoring force of the elastic pieces 115*a*,115*b* to push the insertion 102 toward the ceiling wall 112 is comparatively week, the insertion 102 is likely to come out.

SUMMARY OF THE INVENTION

In view of the foregoing, a first object of the present invention is to provide a downsized terminal metal fitting, and a second object of the present invention is to provide a terminal metal fitting which is capable of preventing an insertion of a mating connection terminal from coming out.

In order to achieve the above first object, as a first aspect of the present invention, a terminal metal fitting for electrically connecting an electric wire to a mating terminal metal fitting comprises: a wire connecting portion to which the electric wire is connected; an electrically contacting portion in which an insertion of the mating terminal metal fitting is inserted; a pair of walls formed on the electrically contacting portion to receive the insertion therebetween; and a pair of elastic pieces formed on one of the pair of walls to push the insertion toward the other of the pair of walls, the insertion being put between the other of the pair of walls and the pair of elastic pieces, wherein the pair of elastic pieces are arranged in an insertion direction of the insertion, while obliquely projecting from the one of the pair of walls toward the other of the pair of walls, and end faces, facing each other, of the pair of elastic pieces, respectively, face the insertion direction of the insertion. As a second aspect of the present invention, in the structure with the above first aspect, the pair of elastic pieces each are formed in a belt-like shape, one end portion of each elastic piece integrally continues from the one of the pair of walls, and the other end portion of each elastic piece obliquely projects toward the other of the pair of walls and is capable of elastically deforming contactably and discontactably therewith.

As a third aspect of the present invention, in the structure with either one of the above aspects, the terminal metal fitting further comprises: a second elastic piece, formed in a belt-like shape, to be put on top of the pair of elastic pieces so that the insertion is pushed toward the other of the pair of walls and securely held between the other of the pair of walls and the second elastic piece.

According to the above-described structures of the present invention, the following advantages are provided.

(1) Since the pair of end faces of the other end portions of the elastic pieces face the insertion direction of the insertion, the pair of elastic pieces are not put on top of each other. Therefore, the vertical thickness of the electrically contacting portion can be decreased, thereby attaining the downsizing of the terminal metal fitting.

(2) A pair of elastic pieces each are formed in a belt-like shape, and one end portion of each elastic piece integrally continues from the one of the pair of walls. And, the other end portion of each elastic piece obliquely projects toward the other of the pair of walls and is capable of elastically deforming contactably and discontactably therewith.

When the insertion is inserted into the electrically contacting portion, an elastic restoring force to push the insertion toward the ceiling wall arises in each of the elastic pieces. Therefore, the insertion can be securely held between the ceiling wall and the elastic pieces, thereby preventing the insertion from coming out of the electrically contacting portion.

(3) The insertion having inserted into the electrically contacting portion is pushed by the second elastic piece in addition to the elastic pieces. Therefore, the insertion can be more securely held inside the electrically contacting portion, thereby preventing the insertion from coming out of the electrically contacting portion.

The above and other objects and features of the present invention will become more apparent from the following description taken in conjunction with the accompanying drawings.

DESCRIPTION OF THE PREFERRED EMBODIMENT(S)

Embodiments of the present invention will now be described in further detail with reference to the accompanying drawings.

Figure 1:
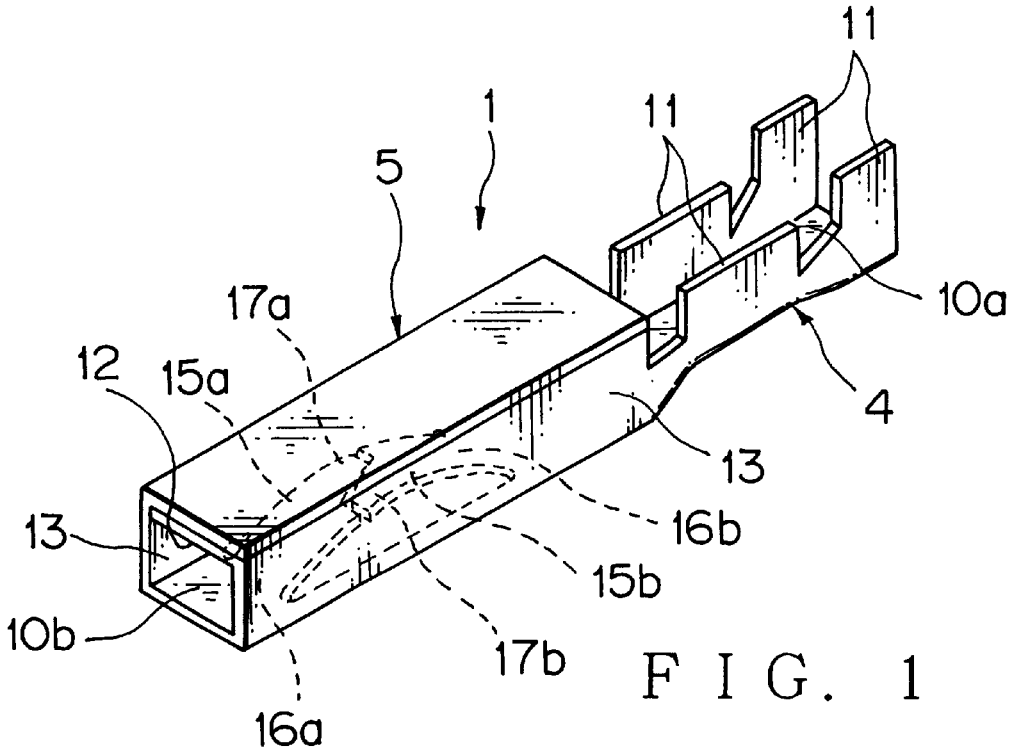
FIG. 1 is a perspective view showing a first embodiment of a terminal metal fitting in accordance with the present invention.
Figure 2:
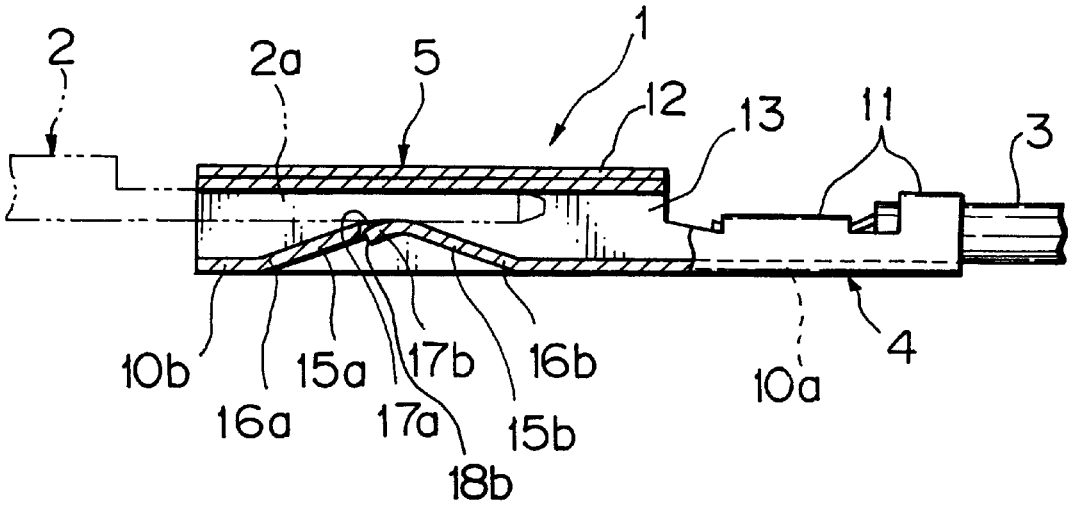
FIG. 2 is a partly sectional side view showing the terminal metal fitting of the same embodiment.

A terminal metal fitting 1 of a first embodiment of the present invention is described referring to FIGS. 1 to 4. The terminal metal fitting 1 shown in FIG. 1 and FIG. 2 is used in order to electrically connect an electric wire 3 with a mating terminal metal fitting 2 (FIG. 2). As the mating terminal metal fitting 2 there are a male tab of busbar or connection terminals of electric parts such as electric relay or fuse.

The mating terminal metal fitting 2 has an insertion 2*a* to be inserted into a later-described electrically contacting portion 5 of the terminal metal fitting 1, as shown in FIG. 2. The insertion 2*a* is formed in a blade-like shape. The mating terminal metal fitting 2 with the insertion 2*a* is made of a conductive metal.

The terminal metal fitting 1 has a wire connecting portion 4, to which the electric wire 3 is connected electrically, and an electrically contacting portion 5 to which the insertion 2*a* of the above mating terminal metal fitting 2 is connected electrically, as shown in FIG. 1 and FIG. 2.

The wire connecting portion 4 has a bottom wall 10*a* and cramping pieces 11 continuing from an edge of the bottom wall 10*a*, as shown in FIG. 1 and FIG. 2. The bottom wall 10*a* is formed flatly. The bottom wall 10*a* is rectangular. An exposed end portion of the electric wire 3 is placed on the bottom wall 10*a*. The cramping pieces 11 continue from both side edges continuing from the bottom wall 10*a*.

The wire connecting portion 4 is electrically connected to the electric wire 3 by inwardly bending the cramping pieces 11 after the wire-exposed end portion of the electric wire 3 has been put on the bottom wall 10*a*.

As shown in FIG. 1 and FIG. 2, the electrically contacting portion 105 is of a hollow quadrilateral cylinder and has a flat bottom wall 10*b*, a ceiling wall 12 facing the bottom wall 10*b*, and a pair of sidewalls 13 connecting the bottom wall 10*b* and the ceiling wall 12. The bottom wall 10*a* of the wire connecting portion 4 and the bottom wall 10*b* of the electrically contacting portion 5 are integrally formed in one plane.

Planar shape of the bottom wall 110*b* is rectangular. Width of the bottom wall 10*b* is generally equal to that of the bottom wall 10*a* of the above wire connecting portion 4. Planar shape of the ceiling wall 12 is almost to that of the bottom wall 10*b*. Planar shape of the ceiling wall 12 is rectangular. The ceiling wall 12 is arranged in parallel with the bottom wall 10*b*.

The sidewalls 13 each continue from the bottom wall 10*b* to the ceiling wall 12. The sidewalls 13 are arranged in parallel each other.

The bottom wall 10*b* and the ceiling wall 12 form a pair of walls in the present invention. That is, the bottom wall 10*b* forms one wall, and the ceiling wall 12 forms the other wall in the present invention.

In the electrically contacting portion 5 the insertion 2*a* is inserted in a longitudinal direction thereof. That is, the insertion 2*a* is positioned between the ceiling wall 12 and the bottom wall 10*b* and the pair of sidewalls 13.

Figure 3:
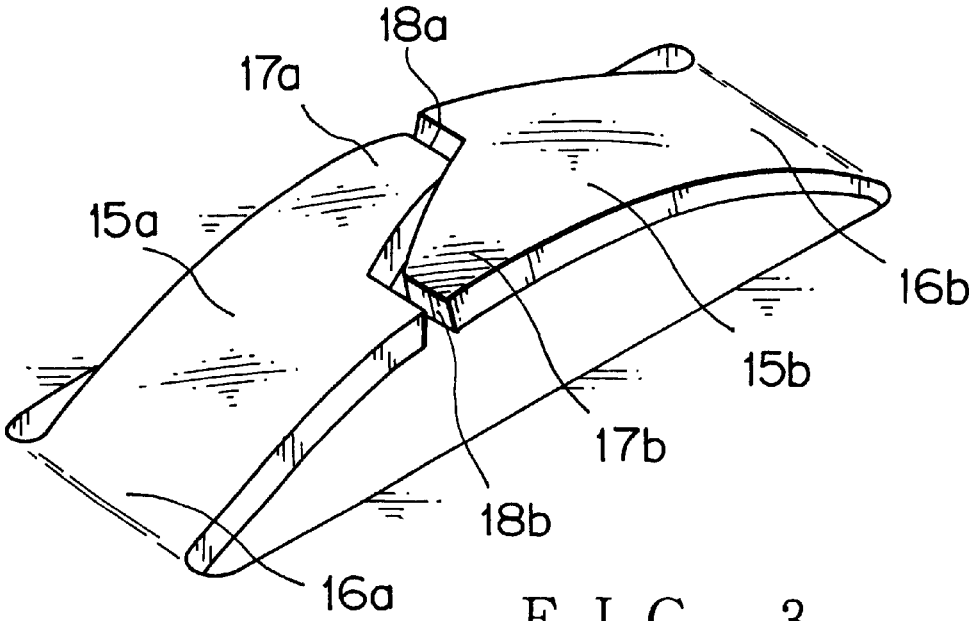
FIG. 3 is a perspective view showing elastic pieces of the terminal metal fitting of the same embodiment.

And, the electrically contacting portion 5 has a pair of elastic pieces 15*a*,15*b* as shown in FIGS. 1 to 3. The pair of elastic pieces 15*a*,15*b* are formed in a belt-like shape and provided on the bottom wall 10*b*. The pair of elastic pieces 15*a*,15*b* are arranged in a longitudinal direction of the bottom wall 10*b*, namely in an insertion direction of the insertion 2*a*.

The longitudinal direction of each of the elastic pieces 15*a*,15*b* is in accordance with that of the above bottom wall 10*b*. End portions 16*a*,16*b* (hereinafter, one end portions) of the respective elastic pieces 15*a*,15*b* integrally continue from the above bottom wall 10*b*.

The pair of elastic pieces 15*a*,15*b* each are formed obliquely from the one end portions 16*a*,16*b* toward the other end portions 17*a*,17*b*, respectively, with respect to the bottom wall 10*b* from the bottom wall 10*b* toward the ceiling wall 12. The pair of elastic pieces 15*a*,15*b* each obliquely project from the bottom wall 10*b*. The other end portions 17*a*,17*b* of the respective elastic pieces 15*a*,15*b* each are to be securely put into contact with the insertion 2*a*.

An end face 18*a* of the other end portion 17*a* of the elastic piece 15*a* opposes the other end portion 17*b* of the elastic piece 15*b*. And, an end face 18*b* of the other end portion 17*b* of the elastic piece 15*b* opposes the other end portion 17*a* of the above elastic piece 15*a*. Accordingly, a pair of end faces 18*a*,18*b* of the other end portions 17*a*,17*b* of the elastic pieces 15*a*,15*b* face the insertion direction of the insertion 2*a* into the electrically contacting portion 5.

And, the elastic pieces 15*a*,15*b* are bent toward the bottom wall 10*b* so that the insertion 2*a* does not abut the other end portions 17*a*,17*b*.

The elastic pieces 15*a*,15*b* each are in a cantilevered state, and the above other end portions 17*a*,17*b* of the respective elastic pieces 15*a*,15*b* can be elastically-deformed contactably and discontactably with the above ceiling wall 12.

When the insertion 2*a* is inserted into the electrically contacting portion 5, both of the other end portions 17*a*,17*b* of the elastic pieces 15*a*,15*b* are securely put into contact with the insertion 2*a*. The other end portions 17*a*,17*b* are displaced in a direction of getting apart from the ceiling wall 12 on inserting the insertion 2*a* into the electrically contacting portion 5. And, the elastic restoring force pushing the insertion 2*a* toward the ceiling wall 12 arises in the elastic pieces 15*a*,15*b*. The insertion 2*a* is put between the elastic pieces 15*a*,15*b* and the ceiling wall 12.

Figure 4:
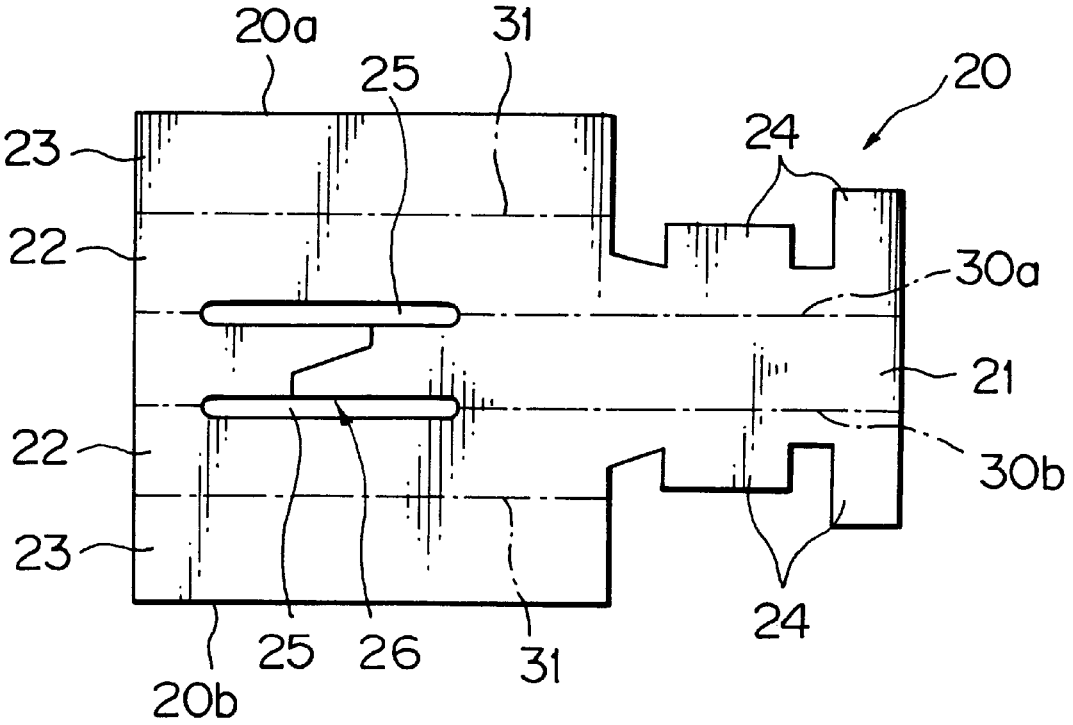
FIG. 4 is a plan view showing a metal plate forming the terminal metal fitting of the same embodiment.

As shown in FIG. 4, the terminal metal fitting 1 is formed, for example, by bending a conductive metal plate 20. The metal plate 20 is formed by punching conductive metal plate such as copper or copper alloy (i.e. brass, beryllium copper, for example). Planar shape of the metal plate 20 is generally rectangular. The metal plate 20, as shown in FIG. 4, has a bottom wall corresponding portion 21 positioned at a general center in its width direction, a pair of sidewall corresponding portions 22, a pair of ceiling wall corresponding portions 23, and a plurality of cramping piece corresponding portions 24. The bottom wall corresponding portion 21 is formed in a belt-like shape along a longitudinal direction of the metal plate 20.

And, the metal plate 20 has slots 25,25 which are provided on respective side edge portions of the above bottom wall corresponding portion 21 in a longitudinal direction of the metal plate 20. The bottom wall corresponding portion 21 corresponds to the bottom walls 10*a*, 10*b* to be formed by bending the metal plate 20 along bending lines 30*a*,30*b*.

The sidewall corresponding portions 22 continue from the respective edges of the bottom wall corresponding portion 21 and each are formed in a belt-like shape in a longitudinal direction of the metal plate 20. The sidewall corresponding portions 22 correspond to the respective sidewalls 13 to be formed by bending the metal plate 20 along the bending lines 30*a*,30*b*,31.

The ceiling wall corresponding portions 23 continue from the respective edges of the sidewall corresponding portions 22 and each are formed in a belt-like shape in a longitudinal direction of the metal plate 20. The ceiling corresponding portions 23 correspond to the respective ceiling walls 12 to be formed by bending the metal plate 20 along the bending lines 31.

The cramping piece corresponding portions 24 extend from the edges of the bottom wall corresponding portion 21 of the above bottom wall 10*a*. The cramping piece corresponding portions 24 correspond to the cramping pieces 11 of the terminal metal fitting 1.

An elastic piece corresponding portion 26 is provided between the slots 25,25 on the metal plate 20, which elastic piece corresponding portion 26 becomes the pair of elastic pieces 15*a*,15*b*.

In forming the terminal metal fitting 1 from the metal plate 20, firstly, the metal plate 20 is bent along the bending lines 30*a*,30*b*,31 shown in FIG. 4, wherein the sidewall corresponding portions 22 face each other and one ceiling wall corresponding portion 23 is put on top of the other ceiling wall corresponding portion 23. The lower ceiling wall corresponding portion 23 faces the bottom wall corresponding portion 21.

As shown, the above bending lines 30*a*,30*b* each extend in a longitudinal direction of the metal plate 20. The pair of bending lines 31 are provided generally in the middle between the edges 20*a*,20*b* and the pair of bending lines 30*a*,30*b*, respectively, and also extend in a longitudinal direction of the metal plate 20.

And, the longitudinal center portion of the elastic piece corresponding portion 26 is cut as shown in FIG. 4 and the cut portions are gradually bent toward the ceiling wall corresponding portions 23 to form the pair of elastic pieces 15*a*,15*b*, thereby obtaining the terminal metal fitting 1 having the wire connecting portion 4 and the electrically contacting portion 5.

According to the above-described structure, when the insertion 2*a* is inserted into the electrically contacting portion 5, the front end portion of the insertion 2*a* is strongly put into contact with the other end portions 17*a*,17*b* of the elastic pieces 15*a*,15*b*. As inserting the insertion 2*a*, the other end portions 17*a*,17*b* elastically deform, getting apart from the ceiling wall 12 side toward the bottom wall 10*b* side.

An elastic restoring force to push the insertion 2*a* toward the ceiling wall 12 arises in each of the elastic pieces 15*a*,15*b*. That is, the insertion 2*a* is pushed toward the ceiling wall 12 by means of the elastic restoring force of the elastic pieces 15*a*, 15*b* and is put between the ceiling wall 12 the elastic pieces 15*a*, 15*b*.

According to the present embodiment, a pair of end faces 18*a*,18*b* of the other end portions 17*a*,17*b* of the elastic pieces 15*a*,15*b* face the insertion direction of the insertion 2*a*.

That is, the pair of elastic pieces 15*a*,15*b* are not put on top of each other. Therefore, the vertical thickness of the electrically contacting portion 5 can be decreased, thereby attaining the downsizing of the terminal metal fitting 1.

And, when the insertion 2*a* is inserted into the electrically contacting portion 5, an elastic restoring force to push the insertion 2*a*toward the ceiling wall 12 arises in each of the elastic pieces 15*a*,15*b*. Therefore, the insertion 2*a*can be securely held between the ceiling wall 12 and the elastic pieces 15*a*,15*b*, thereby preventing the insertion 2*a* from coming out of the electrically contacting portion 5.

Figure 5:
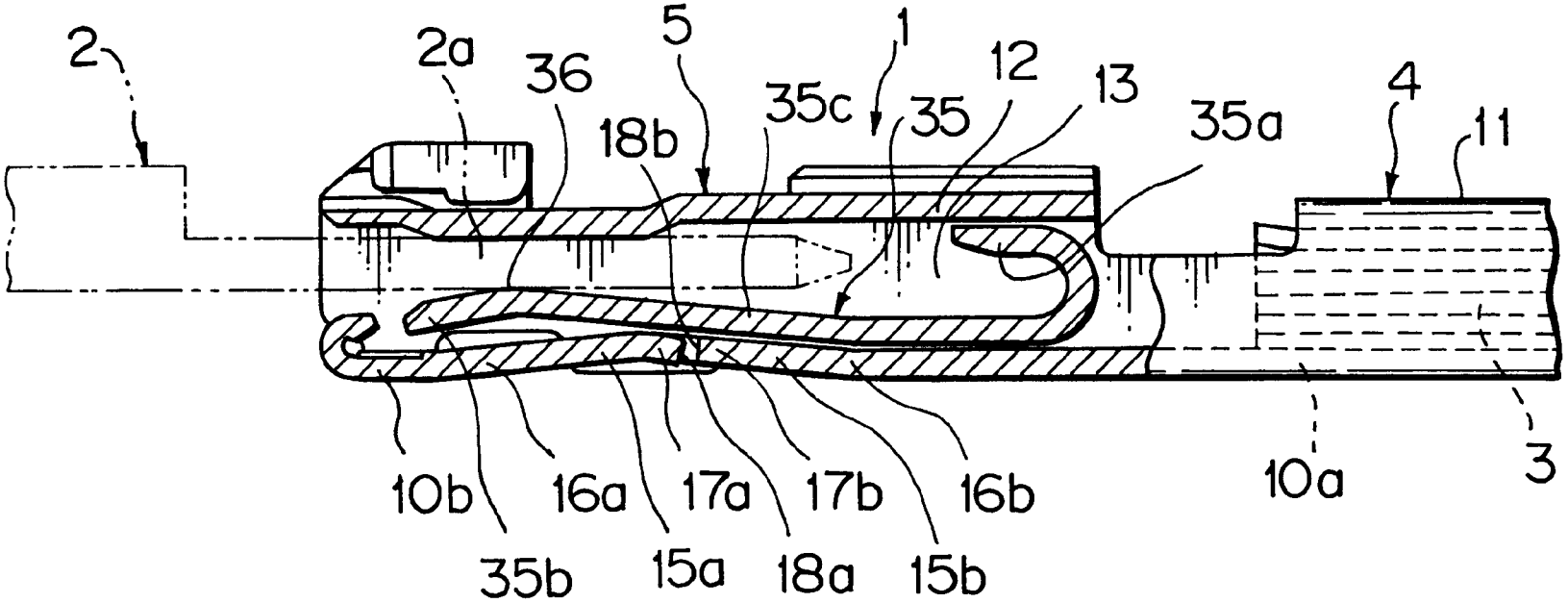
FIG. 5 is a sectional view showing a second embodiment of the terminal metal fitting in accordance with the present invention.
Figure 6:
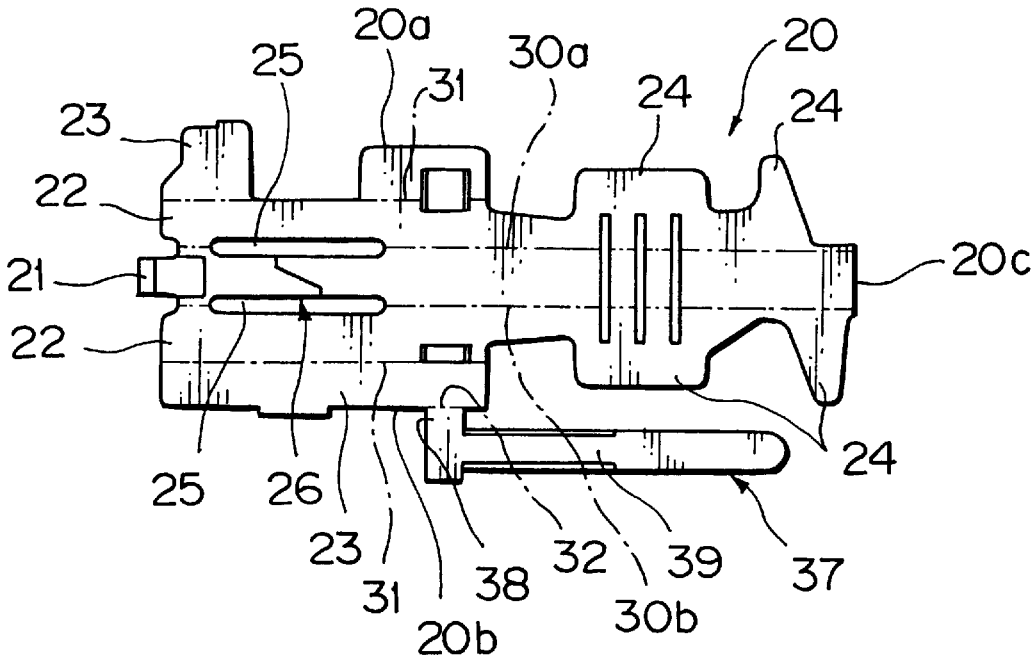
FIG.6 is a plan view showing a metal plate forming the terminal metal fitting shown in FIG.5.
Figure 7:
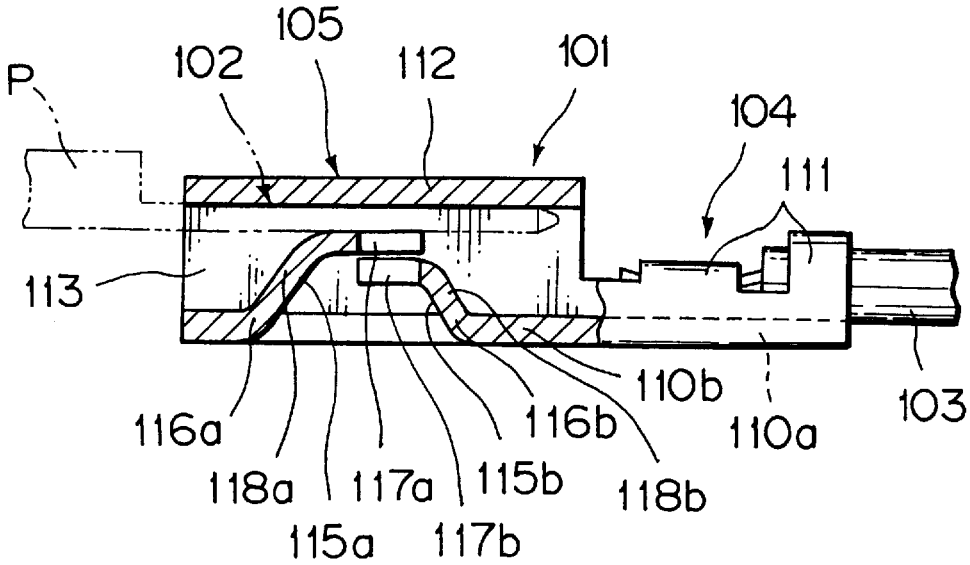
PRIOR ART F I G. 7
FIG. 7 is a partly sectional side view showing a prior art terminal metal fitting.

Next, a second embodiment of the terminal metal fitting 1 in accordance with the present invention is described referring to FIG. 5 and FIG. 6.

The same reference characters are designated to the same elements of the first embodiment, and the description is omitted.

The terminal metal fitting 1 of the present embodiment has a second elastic piece 35, as shown in FIG. 5. The second elastic pieces 35 is formed in a belt-like shape along the insertion direction of the insertion 2*a*. The second elastic piece 35 is put on top of the elastic pieces 15*a*,15*b*. That is, the second elastic piece 35 is placed between the elastic pieces 15*a*,15*b* and the ceiling wall 12.

One end portion 35*a* of the second elastic piece 35 continues from a portion of the ceiling wall 12 close to the wire connecting portion 4. The other end portion 35*b* of the second elastic piece 35 is positioned at the vicinity of the front edge of the bottom wall 10*b*, and bendingly extends from the above one end portion 35*a* toward the front edge of the bottom wall 10*b*. The second elastic piece 35 is in a cantilevered state.

The second elastic piece 35 has an elastic pressing portion 36. The elastic pressing portion 36 is provided on the vicinity of the other end portion 35*b* of the second elastic piece 35. A middle portion 35*c* of the elastic pressing portion 36 projects to a certain extent toward the ceiling wall 12.

The elastic pressing portion 36 of the cantilevered second elastic piece 35 can be elastically-deformed contactably and discontactably with the above ceiling wall 12.

When the insertion 2*a* is inserted into the electrically contacting portion 5, the second elastic piece 35 is securely put into contact with the insertion 2*a*. The elastic pressing portion 36 is displaced in a direction of getting apart from the ceiling wall 12 on inserting the insertion 2*a* into the electrically contacting portion 5. And, the elastic restoring force pushing the insertion 2*a* toward the ceiling wall 12 arises in the second elastic piece 35. The insertion 2*a* is put between the second elastic piece 35 and the ceiling wall 12.

The terminal metal fitting 1 is formed by bending a conductive metal plate 20 show in FIG. 6. The metal plate 20 has a second elastic piece corresponding portion 37, as shown in FIG. 6.

The second elastic piece corresponding portion 37 has a connecting portion 38 and an elastic portion 39. The connecting portion 38 is connected to an edge of one of the ceiling wall corresponding portions 23. The connecting portion 38 projects from the one of the ceiling wall corresponding portions 23. That is, the connecting portion 38 extends outward from the edge 20*b* of the metal plate 20.

The elastic portion 39 extends from the above connecting portion 38 in a belt-like shape along a longitudinal direction of the metal plate 20 toward the rear edge 20*c* of the metal plate 20.

In forming the terminal metal fitting 1 from the metal plate 20, firstly, the metal plate 20 is bent along the bending lines 30*a*,30*b*,31 shown in FIG.6. And, the longitudinal center portion of the elastic piece corresponding portion 26 is cut and the cut portions are gradually bent toward the ceiling wall corresponding portions 23 to form the pair of elastic pieces 15*a*,15*b*.

Further, the second elastic piece corresponding portion 37 is folded toward the ceiling wall corresponding portion 23 along a bending line 32 shown in FIG.6. The bending line 32 is along the edge 20*b* of the metal plate 20. The second elastic piece corresponding portion 37 is reversely folded toward the electrically contacting portion 5. The other work is substantially the same as of the first embodiment.

According to the above-described structure, when the insertion 2*a* is inserted into the electrically contacting portion 5, the front end portion of the insertion 2*a* is strongly put into contact with the elastic pressing portion 36 of the second elastic piece 35. As inserting the insertion 2*a*, the elastic pressing portion 36 of the second elastic piece 35 elastically deforms, getting apart from the ceiling wall 12 side toward the bottom wall 10*b* side. At the same time, the elastic pieces 15*a*,15*b* elastically deform toward the bottom wall 10*b* side.

The elastic restoring force to push the insertion 2*a* toward the ceiling wall 12 arises in the second elastic piece 35 and also in the elastic pieces 15*a*,15*b*. Therefore, the insertion 2*a*can be securely held between the ceiling wall 12 and the second elastic piece 35, thereby preventing the insertion 2*a* from coming out of the electrically contacting portion 5.

According to the present embodiment, similarly to the first embodiment, the pair of end faces 18*a*,18*b* of the other end portions 17*a*,17*b* of the elastic pieces 15*a*, 15*b* face the insertion direction of the insertion 2*a*. Therefore, the vertical thickness of the electrically contacting portion 5 can be decreased, thereby attaining the downsizing of the terminal metal fitting 1.

And, the insertion 2*a* having inserted into the electrically contacting portion 5 is pushed by the second elastic piece 35 in addition to the elastic pieces 15*a*,15*b*. Therefore, the insertion 2*a* can be more securely held inside the electrically contacting portion 5, thereby preventing the insertion 2*a* from coming out of the electrically contacting portion 5.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. A terminal metal fitting for electrically connecting an electric wire to a mating terminal metal fitting, comprising:

a wire connecting portion to which the electric wire is connected;

an electrically contacting portion in which an insertion of the mating terminal metal fitting is inserted;

a bottom wall, a pair of side walls, and a ceiling wall formed on the electrically contacting portion to receive the insertion therebetween; and a pair of elastic pieces formed on the bottom wall to push the insertion toward the ceiling wall, the insertion being put between the ceiling wall and the pair of elastic pieces, wherein the pair of elastic pieces are arranged in an insertion direction of the insertion, while gradually approaching each other and obliquely projecting from the bottom wall toward the ceiling wall, and end faces, facing each other, of the pair of elastic pieces, respectively, face the insertion direction of the insertion, and the end face of an end portion of one of said pair of elastic pieces opposes a drawn-back portion of an end portion of the other of said pair of elastic pieces, while the end face of said end portion of said other of said pair of elastic pieces opposes a drawn-back portion of said end portion of said one of said pair of elastic pieces.

2. The terminal metal fitting as set forth in claim 1, wherein the pair of elastic pieces each are formed in a belt shape, one end portion of each elastic piece integrally continues from the bottom wall, and the other end portion of each elastic piece obliquely projects toward the ceiling wall and is capable of elastically deforming while contacting or separating from the ceiling wall by virtue of the insertion.

3. The terminal metal fitting as set forth in claim 1, further comprising:

a second elastic piece, formed in a belt shape, to be put on top of the pair of elastic pieces so that the insertion is pushed toward the ceiling wall and securely held between the ceiling wall and the second elastic piece.

4. The terminal fitting as set forth in claim 2, further comprising:

a second elastic piece, formed in a belt shape, to be put on top of the pair of elastic pieces so that the insertion is pushed toward the ceiling wall and securely held between the ceiling wall and the second elastic piece.

* * * * *